US007392741B2

(12) United States Patent
Maggio

(10) Patent No.: US 7,392,741 B2
(45) Date of Patent: Jul. 1, 2008

(54) SUPPORTING AND RELEASABLY HOLDING DEVICE FOR A PRINTING CYLINDER HUB

(75) Inventor: Claudio Maggio, Bussolengo (IT)

(73) Assignee: Maria Grazia Valentini, Verona (IT)

( * ) Notice: Subject to any disclaimer, the term of this patent is extended or adjusted under 35 U.S.C. 154(b) by 333 days.

(21) Appl. No.: 11/222,584

(22) Filed: Sep. 9, 2005

(65) Prior Publication Data

US 2006/0070539 A1 Apr. 6, 2006

(30) Foreign Application Priority Data

Sep. 10, 2004 (IT) ..... VR2004A0141

(51) Int. Cl.
*B41F 5/00* (2006.01)

(52) U.S. Cl. ..... 101/216; 101/153; 101/247; 101/479

(58) Field of Classification Search ..... 101/150, 101/153, 212, 216, 247, 375, 376, 479, 480, 101/485; 492/18, 48
See application file for complete search history.

(56) References Cited

U.S. PATENT DOCUMENTS

| | | | | |
|---|---|---|---|---|
| 4,697,516 | A | 10/1987 | Rombout | |
| 5,380,047 | A * | 1/1995 | Molee et al. | 283/86 |
| 5,778,779 | A | 7/1998 | Jones et al. | |
| 5,784,961 | A * | 7/1998 | Lorig et al. | 101/375 |
| 5,906,162 | A | 5/1999 | Kolbe et al. | |
| 6,176,181 | B1 * | 1/2001 | Van Ryzin et al. | 101/216 |
| 6,343,547 | B1 * | 2/2002 | Callahan et al. | 101/216 |
| 6,644,188 | B2 * | 11/2003 | Kolbe et al. | 101/375 |
| 7,287,472 | B2 * | 10/2007 | Rogge et al. | 101/352.01 |

* cited by examiner

*Primary Examiner*—Ren Yan
(74) *Attorney, Agent, or Firm*—Orum & Roth LLC

(57) ABSTRACT

A printing machine color assembly presenting a main or cliché-carrying cylinder (2) and an interlocking or screened cylinder (3), each carried at its hubs (2*a*, 2*b*; 3*a*, 3*b*) by first (4*a*; 5*a*—operator side) and second (4*b*; 5*b*—motor side) slidable supports positioned on different sides of the printing machine and parallel displaceable independently from one another. The first support (5*a*) of at least said main cylinder (2) is detachable from the respective hub (2*a*) to cantilever-wise position the main cylinder (2) on the second support (5*b*) thereby carrying out the sleeve replacement on the main cylinder (2). At least one auxiliary supporting means (17) at the second support (5*b*) of at least the main cylinder (2) is designed to engage with, and assist in supporting, it when cantileverwise positioned for replacing a sleeve.

14 Claims, 6 Drawing Sheets

SUPPORTING AND RELEASABLY HOLDING DEVICE FOR A PRINTING CYLINDER HUB

FIELD OF THE INVENTION

The present invention relates to a supporting and releasably holding device for a hub of a rotatable cylinder particularly but not exclusively suitable for replacing an anilox or cliché-carrying sleeve in a flexographic machine or in general in a printing machine, as well as to the use of linear motors for operating slide supports of cylinder hub.

BACKGROUND OF THE INVENTION

As it is well-known, each color assembly or unit in a multicolor flexographic machine comprises a pair of cylinders, i.e. a screened and a cliché-carrying cylinder, respectively, that are parallel to one another and slidingly displaceable between a working position, in which the anilox or screened cylinder, i. e. an etched steel cylinder with a wide range of screen frames having from 3 to 200 lines per centimeter, is located in contact with the cliché-carrying cylinder positioned, in turn, in contact with a counterpressure or printing drum, and a rest position, in which the two cylinders are parallelly shifted or moved away from one another and from the counterpressure drum. Both screened and cliché-carrying cylinders have a hub member at each end thereof, which is designed to be mounted for rotation on a respective slide slidingly connected to, and supported by, a respective side of the support frame of a printing machine.

It has already been proposed, see Patent EP-1 199 167, how rotatably to support the hubs of a screened cylinder by means of a pair of cradle-shaped supports, to which a respective counter-cradle or cap member is articulated, that is angularly displaceable about a pin which is fixed to the cradle and has its longitudinal axis parallel to that of the cylinder, thereby obtaining a shape engagement with a portion of a respective hub of the cylinder supported for rotation in the cradle. Each cap member is angularly displaceable between a working position, where it is positioned abutting engagement with the cradle thereby rotatably holding the cylinder hub, and a rest position, where it opens upwards by rotating about its pin, thereby releasing the hub cylinder hub and allowing it to be removed or installed therein.

Such a solution, however, has some non-negligible drawbacks from the practical point of view. As a matter of fact, the use of a cap or counter-cradle system, also owing to the unavoidable presence of leverages operated by linear actuators, results in non-negligible clearances being created between hub and cradle-countercradle, which clearances affect the print quality at least in the long run.

It has already been also suggested—see ES-2 127 658—a method of replacing a cliché-carrying or anilox sleeve, such a method involving the following sequential operations:

- detaching cylinders from counterpressure drum;
- moving side counter-cradles away from their respective hub-carrying cradles of each cylinder;
- displacing one hub-carrying cradle of the cylinder, so that the latter remains cantileverwise supported by its other hub-carrying cradle;
- replacement of the sleeve;
- return of hub-carrying cradle to a receiving position of the cylinder hub, i.e. to its starting position;
- automatic or manual return of counter-cradle to its closed position on the cradle; and
- return of cylinder (cliché-carrying or screened cylinder) to its working position in abutting engagement with the counter-pressure drum.

During sleeve replacement and more precisely upon disengagement of one hub from the cradle, i.e. while the other cradle on the motor side of the printing machine entirely cantileverwise supports the cylinder, the cylinder weight can be considered to be a static load, which applies a bending moment to one of the cradles and its respective pad or bushing. With the lengths and the weight involved, the bending moment generated is always high and can deform the cradle and damage the (frustoconical) pad on which the hub rests.

With presently available technical solutions, some of which have been mentioned above, the operator is actively involved throughout the entire sleeve replacing procedure to carry out the hub disengagement/engagement and removing/laying operations in relation to the cradle after replacing the sleeve, once a sleeve has been replaced.

Another drawback of printing machines of the prior art in general is the use of rotary motors with motion transmission by means of ball screws for causing linear displacements of cliché-carrying and anilox cylinder supports away from or towards a counterpressure drum. As a matter of fact, as it is known to a person skilled in the art of the printing machines, such a cylinder handling system is responsible for considerable clearance, which in any case can cause printing inaccuracies greater than a hundredth of a millimeter that cannot be tolerated if a good print quality is to be obtained. Moreover, rotary motors are provided with circular encoders, which do not allow the exact position of the operated cylinders to be detected, whereby a reckoning algorithm is required in the electronic control unit of the printing machine.

SUMMARY OF THE INVENTION

The main object of the present invention is to provide a supporting and releasably holding device for a hub of a cylinder of a printing machine, which is capable of eliminating or drastically reducing the above-mentioned drawbacks.

Another object of the present invention is to provide a supporting and releasably holding device which is highly reliable, long lasting, and operates with precision.

A further object of the present invention is to provide an auxiliary supporting means to counterbalance the cantilever extension of a cliché-carrying and/or screened cylinder during a sleeve replacement operation, thereby eliminating or drastically reducing undesired strain both in the cradle and its respective pad, which remains engaged with the cliché-carrying cylinder at the motor side of the printing machine.

Another object of the present invention is to obtain a more accurate, secure, and rapid method of replacing a printing sleeve, that is carried out in a completely automatic manner, i. e. the operator has only to execute sleeve extraction/inserting operations, whereas all the remaining of sleeve replacement operations are carried out by the printing machine.

Another object of the present invention is to provide an drive system for displacing and positioning cliché-carrying and screened cylinders, which is suitable for drastically reducing or limiting clearances in handling cliché-carrying and screened cylinder supports, whereby ensuring high accuracy in cylinders positioning and excellent print quality.

Another object of the present invention is to put one in a position of detecting the precise linear position of cylinders both relatively to one another and with respect to the counterpressure drum at any time during a color unit operation of a printing machine, thereby making it possible accurately to relocate the printing cylinders. A further object of the present invention is to provide a supporting and releasably holding device that can be manufactured at low production costs.

According to a first aspect of the present invention, there is provided a supporting and releasably holding device for a printing machine cylinder hub, which comprises a first pair of slidable supports that are parallelly displaceable along a first path independently from one another, a second pair of slidable supports that are independently parallelly displaceable along a second path parallel to said first path, a main or sleeve-carrying cylinder, and a screened or interlocking cylinder which are supported for rotation at each of their terminal hub by means of a respective pair of said slidable supports, and drive means for displacing each slidable support, characterized in that at least one slidable support of said pair of supports for at least said main cylinder comprises a receiving seat having a side inlet/outlet mouth, a sleeve member supported for rotation in said receiving seat and having a longitudinal slit for inserting/removing a respective hub of a cylinder, and a displacing means arranged angularly to displace said sleeve member about its longitudinal axis in said receiving seat between a lateral open position, in which said longitudinal slit is positioned in front of said inlet-outlet mouth to let the hub of its respective cylinder to pass therethrough, and a closed position, in which said longitudinal slit is angularly displaced with respect to said inlet-outlet mouth.

Advantageously, said drive means comprises at least one linear motor, preferably an electric linear motor for each slidable support of the main or cliché-carrying cylinder and the interlocking or screened cylinder.

According to another aspect of the present invention, there is provided a method for replacing a printing machine sleeve, including the above described supporting and releasably holding device, which method comprises:

- arranging said main cylinder in a rest position relatively far from both a counterpressure drum and said interlocking cylinder, and characterized in that it comprises the steps of:
- angularly displacing about its longitudinal axis a sleeve member seated in a respective slidable support at the operator side of said printing machine thereby moving it to its open position to allow its respective hub to pass through it;
- displacing said slidable support for said sleeve member transversally with respect to said longitudinal axis of said sleeve member from a work position to a sleeve replacement position thereof, thereby releasing and moving away from its respective hub of said main cylinder, which becomes positioned cantileverwise;
- inserting or replacing a sleeve onto said main cylinder;
- displacing backwards said slidable support for said sleeve member from said sleeve replacement position to said work position;
- angularly displacing said sleeve member to its closed position thereby holding in position its respective hub of said main cylinder;
- if required, displacing said main cylinder from said rest position to a work position against said counterpressure drum.

More particularly, the present invention relates to a color assembly or unit for a printing machine, presenting a main or cliché-carrying cylinder and an interlocking or screened cylinder, each supported at its hub by means of first and second slidable supports located on different sides of said printing machine and parallelly displaceable independently from one another, said first support of at least said main cylinder being disengageable from its respective hub to locate its respective cylinder cantileverwise on said second support thereby carrying out sleeve replacement thereon, characterized in that it comprises at least one auxiliary support means at said second support of at least said main cylinder designed to engage therewith and to assists in supporting it when cantileverwise positioned for a sleeve replacement.

Advantageously, said first support is displaceable between a working position, in which it engages with, and supports, said hub of its respective cylinder, and a rest position, in which it is moved away from its respective cylinder, which is thus cantileverwise supported on said second support.

During a sleeve replacement step, its respective cantileverwise positioned cylinder is thus supported both by its second support at the motor side opposite to operator's sleeve replacing side and by said auxiliary supporting means. In this way, any bending moment generated by cylinder weight throughout its length is mostly discharged onto its auxiliary support means.

Such an auxiliary supporting means can be applied in some or in each color assembly or unit of a printing machine where a sleeve replacing end of a (main or interlocking) cylinder is arranged to be released from its support.

BRIEF DESCRIPTION OF THE DRAWINGS

Further features and advantages of the present invention will better appear from the following detailed description of some presently preferred embodiments thereof, given by way of non-limiting examples of carrying out the invention, with reference to the accompanying drawings, in which.

In the accompanying drawings the same or similar parts or components are indicated with the same reference numerals.

DESCRIPTION OF THE PREFERRED EMBODIMENTS OF THE INVENTION

Figure 2:
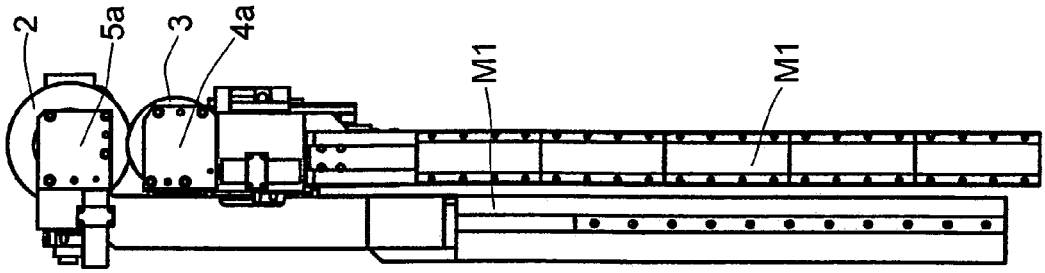
FIG. 2 is a side view of FIG. 1.

With reference first to the above listed Figures, it will be noted that a flexographic color assembly or unit 1 comprises, among others, a cliché-carrying or sleeve-carrying main cylinder 2 and a screened or interlocking cylinder 3, which are provided at their ends with respective axially aligned hubs 2*a*, 2*b* and 3*a*, 3*b* (hub 3(*b*) is not illustrated in the drawings), as is well-known by a skilled person in the art.

Figure 5:
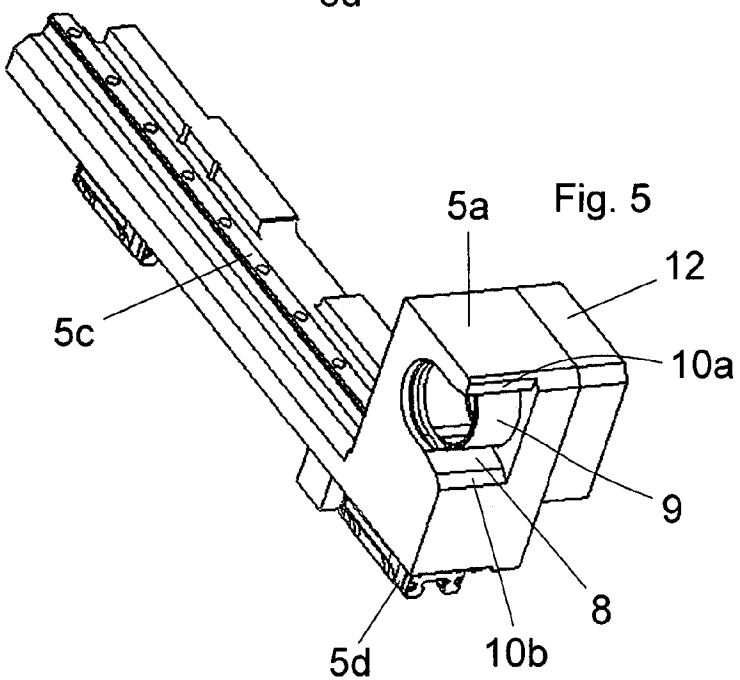
FIG. 5 shows a partial perspective view slightly from above of a slidable support provided with a releasably holding device having a sleeve member in its closed position.

Hubs 3*a*, 3*b* of screened cylinder 3 are supported for rotation on a first pair of slide supports 4*a* and 4*b*, which are in turn slidingly mounted on respective parallel guides 5*c* (FIG. 5) provided on a second pair of slide supports 5*ae* 5*b*, each rotatably supporting a respective hub 2*a*, 2*b* of the cliché-carrying cylinder 2, and being provided with guide members 5*d* designed slidingly to engage with respective guides (not shown in drawings) parallel to guides 5*c* and provided on a respective side of a color printing machine (also not shown in drawings).

Preferably, each slidable support 4*a*, 4*b* and 5*a*, 5*b* is square-shaped with a longitudinal sliding portion and a transversal end portion rising from the longitudinal portion for supporting a respective hub 2*a*, 2*b* and 3*a*, 3*b*.

With this structure it is possible to cause first and second pair of slide supports 4*a*, 4*b* and 5*a*, 5*b* parallelly to displace independently from one another. Similarly, slide supports of a same pair can be linearly displaced independently from one another, but all in the same direction. To this end, use is made of linear drive means, preferably linear electric motors M (FIG. 11), which can be of both variable and fixed reluctance-type, instead of conventional rotary motors with motion transmission by means of ball screws, as with rotary motor systems undesired clearances might be generated, which result in intolerable inaccuracies in the positioning, which must be as accurate as possible, of slide supports 4*a*, 4*b* and 5*a*, 5*b* throughout the respective side of the printing machine, as it is known in the art. Such inaccuracies also prevent cylinders from being positioned in a repeatable manner.

Advantageously, various linear electrical motors M are controlled by an electronic control unit of any suitable type (not shown in drawings) and usually provided in a modern printing machine to sequentially co-ordinate and synchronize various components of the pressing machine, including any displacement of the slide supports 4*a*, 4*b* and 5*a*, 5*b*.

As better shown in FIG. 2, a sequence of permanent magnets M1 is provided on the slidable supports 4*a* and 4*b* at their sliding portion, said magnet sequence constituting a portion of its respective linear motor M and being made e.g. of magnetic rare earth material having to a larger or less extent forced hysteresis curve. Permanent magnets M1 are mechanically connected to a section of each side (motor side and operator's side) of the printing machine along the longitudinal sliding portion of the slidable supports 5*a* and 5*b* and on the sliding portion of the supports 5*a* and 5*b*. Magnets M1 are the "motive" portion of their respective linear motor M, whose fixed or stator portion comprises one or more windings or coils M2 housed in a respective side of the printing machine and on the respective slidable support 5*a*, 5*b*.

Hub 2*b* (motor side) of the cliché-carrying cylinder 2 is directly keyed or otherwise (gearless) connected to the output shaft of a respective electric motor 6 designed to drive the cliché-carrying cylinder 2 at a controlled rate and to ensure a high torsional stiffness between motor and cylinder with no clearance and parts subject to wear down. Hub 3*b* (motor side) of the screened cylinder 3 is connected, preferably by means of a belt (not shown in drawings) or another suitable drive means, to the output shaft of a respective electric motor 6*a* shifted with respect to the screened cylinder 3 for overall dimensions reasons. Both motors 6 and 6*a* are preferably of a brushless type and can be controlled together with the other color assemblies satellite-wise arranged (i.e. angularly spaced from one another or stack-wise disposed) about a counterpressure drum, typically by means of an electronic control unit (not shown in the drawings and of any suitable type as is well known to a skilled person in the art).

As is better shown in FIGS. 4 to 10, on one side of each transversal portion supporting each slide support 5*a* and designed to carry a hub 2*a* and, if desired, on one side of each portion supporting each slide support 4*a* and designed to carry a hub 3*a* there is provided a receiving seat 7 having an inlet-outlet lateral mouth 8 for the passage of the cliché-carrying cylinder hub 2*a* or the screened cylinder hub 3*a*. Mouth 8 is laterally facing the displacement direction of its respective slidable support. Each receiving seat 7 is arranged rotatably to house and support a coupling member 9 having a longitudinal slit 9*a* for inserting/releasing a respective hub.

Respective collars 2*c* are preferably inserted onto hubs 2*a* and 2*b* of the main cylinder 2 and hubs 3*a* and 3*b* of the interlocking cylinder 3, the collars being arranged to ensure correct rolling movement of their respective hub, when driven by a respective motor 6 and 6*a*, into a respective coupling member 9 both at motor side and operator's side.

In the support portion of each slide support 4*a* and 5*a*, inlet-outlet mouth 8 preferably comprises two inclined plane-shaped surfaces 10*a* and 10*b* designed to assist insertion into, and release from, it of a respective cylinder hub.

Coupling member or sleeve 9 is angularly displaceable about its longitudinal axis in its receiving seat 7 between a laterally open position, in which its lateral slit 9*a* is positioned at the inlet-outlet mouth 8 for the passage of the hub 2*a* of the main cylinder 2 or of the hub 3*a* of the interlocking cylinder 3, and a closed position, where slit 9*a* is angularly displaced with respect to the inlet-outlet mouth 8 by a suitable drive means 11, e.g. a pneumatic or electric motor suitably fixed to the slide supports 5*a* and 5*b*, e.g. through a pair of jacks 11 a arranged on opposite side with respect to the slide supports 5*a* and 5*b*.

Preferably, the output shaft of the pneumatic motor 11 is arranged to drive a worm screw 11*b* engaging with a keyed helical toothed wheel 11*c*, which rotates rigid in rotation with a respective coupling sleeve 9, so that rotational motion is transmitted from the output shaft of the pneumatic motor 11 to the sleeve 9, which is thus angularly displaced between its laterally open position and its closed position.

Between sleeve 9 and toothed wheel 11*c* a pad or bushing 11*d* can be provided (FIG. 9), which is preferably housed in a respective slidable support 4*a* or 5*a* and also acts as a protection member for the sleeve 9 against any torsional stress.

At one end of worm screw head 11*b* a flanged support bush 11*e* can be suitably fixed, thereby avoiding any clearance between worm screw 11*b* and toothed wheel 11*c* being formed, which would cause both gears to wear down and become damaged.

Advantageously, an housing box member 12 is provided to protect both toothed wheel 11*c* and worm screw 11*b*.

Supporting and releasably holding device for collar 2*c* of a hub 3*a* of an interlocking (screened) cylinder 3, preferably at the inner end of the sleeve member 9 a splash guard member 13 angularly displaceable together with the sleeve member 9, which makes it possible for color (ink) projected in an almost radial direction by the interlocking cylinder while rotating, to be at least partly recovered.

Figure 6:
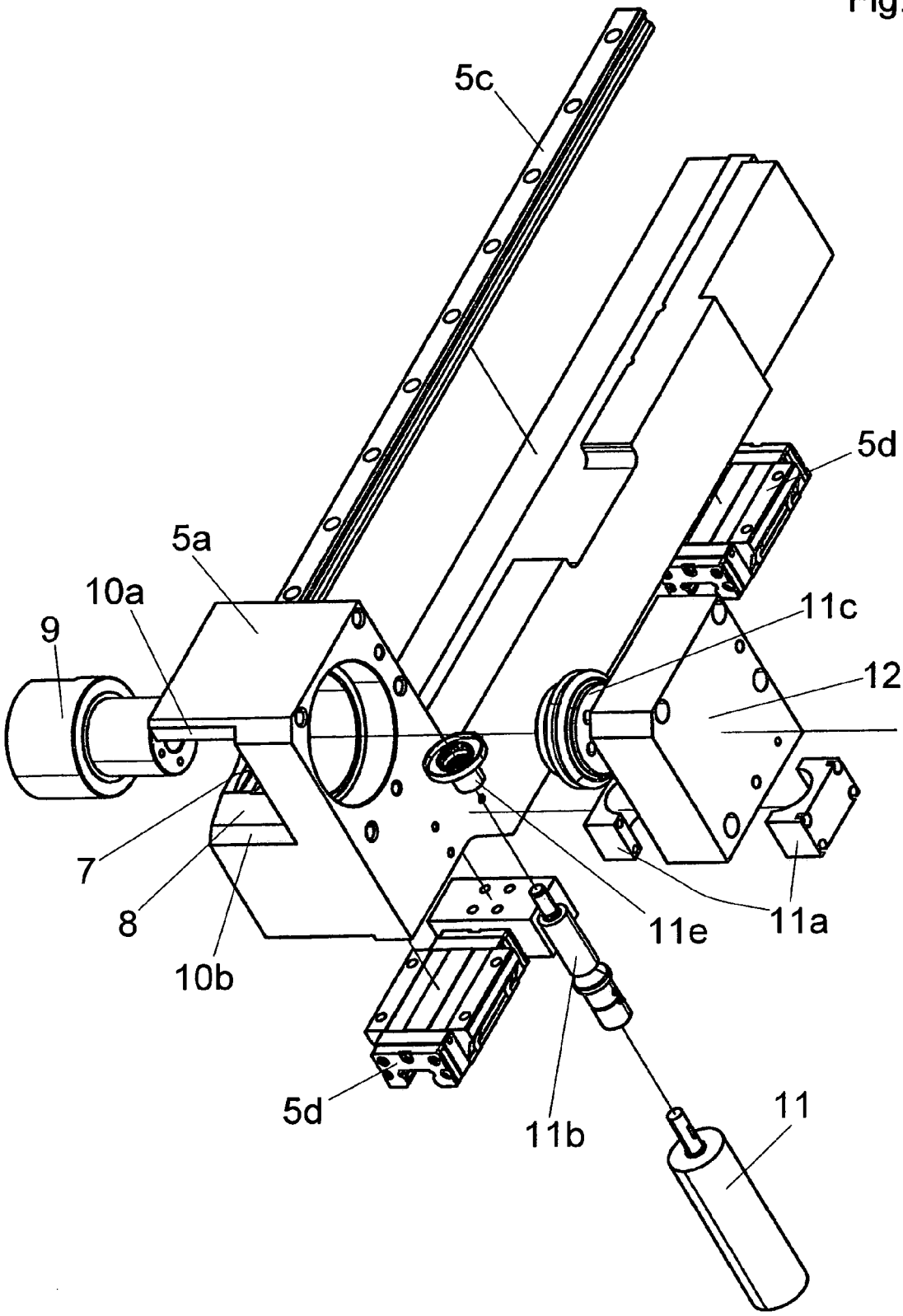
FIG. 6 is an exploded perspective view of the slidable support of FIG. 5.
Figure 8:
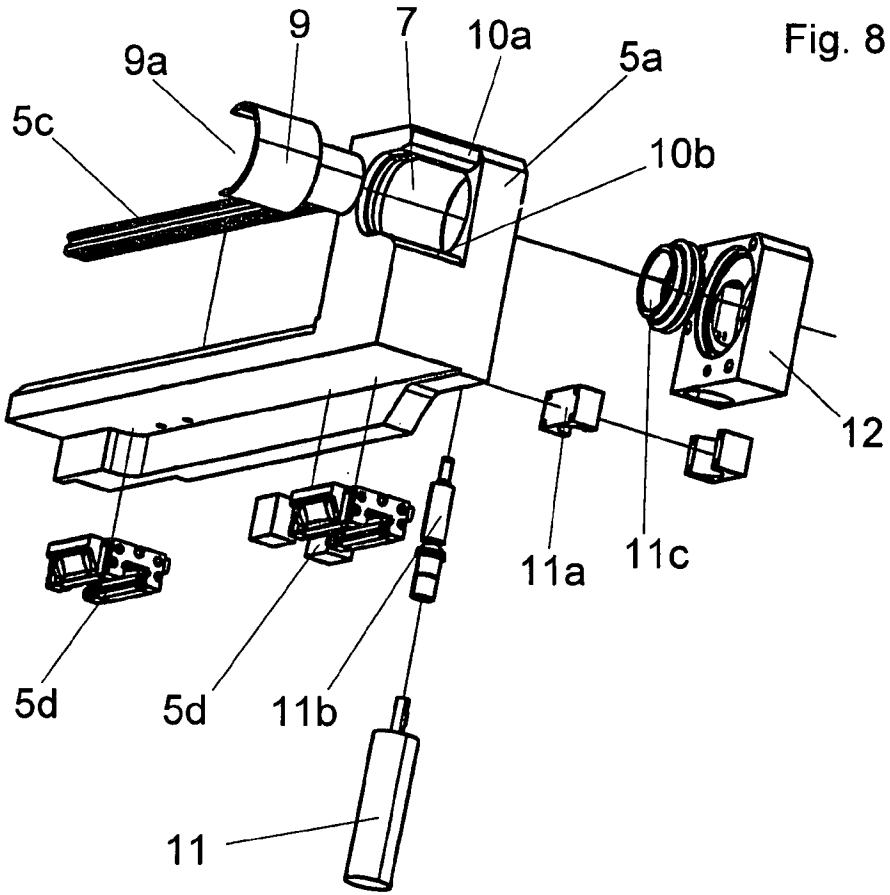
FIG. 8 is an exploded perspective view similar to that of FIG. 6, but with a slidable support viewed from a different angle.
Figure 7:
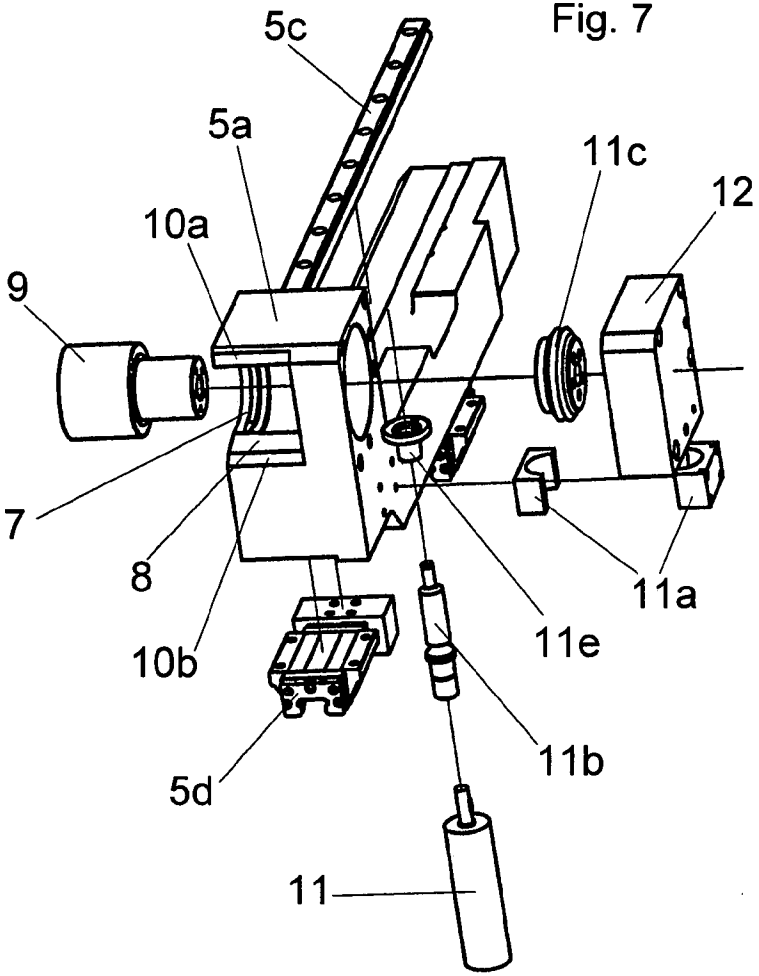
FIG. 7 is an exploded perspective view similar to that of FIG. 6, but with a slidable support viewed from a different angle.
Figure 9:
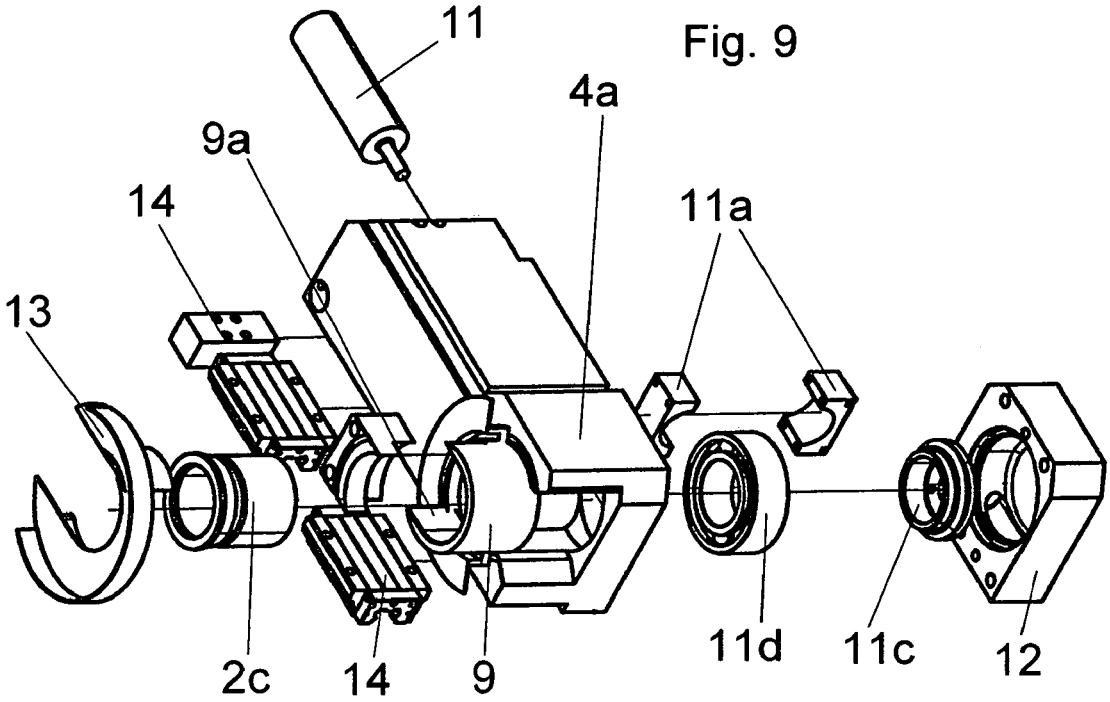
FIG. 9 is a partly exploded view of a slidable support provided with a releasably holding device in its close position for supporting a screened cylinder.
Figure 10:
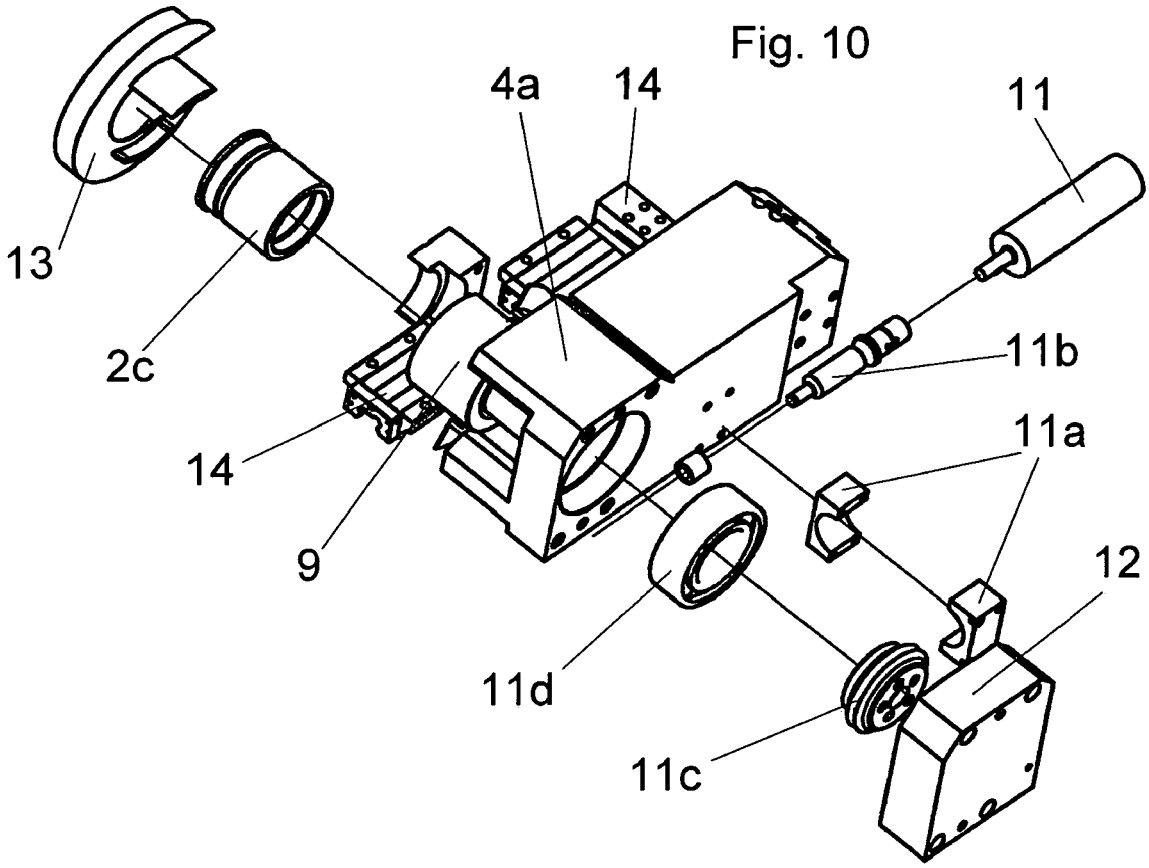
FIG. 10 is a perspective view similar to that of FIG. 9, but with a slidable support viewed from a different angle.

Underneath each slide support 4*a*, 4*b* and 5*a*, 5*b* its respective sliding guides 14 and 5*d* are removably fixed to printing machine sides and on slidable supports 5*a* and 5*b*, respectively, and are preferably of female dovetail-type arranged slidingly to engage with respective parallel male guides, such as those indicated at 5*c* in FIG. 6.

With the above described (both flexographic and anilox) sleeve replacing structure the following operation sequence is to be carried out.

At the beginning, if the cliché-carrying cylinder 2 is not in its rest position yet, the whole color assembly is moved backward with respect to counterpressure drum to its rest position relatively far from counterpressure drum so that its sleeve can be replaced. The sleeve member 9 is then caused angularly to be displaced about its axis of rotation to its rest position thereby allowing its respective hub 2*b* of a cliché-carrying cylinder 2 to enter, or come out from, it at operator's side of the printing machine.

Then, only the slide support 5*a* is caused to further move backwards along the operator's side of the printing machine. In this way, the cliché-carrying cylinder 2 at its hub 2*b* (motor side) rests almost in position on its sleeve member 9, whereas its hub at its displaced slide support 5*a* is fully released from its sleeve member 9 that has been moved away from it, whereby cylinder 2 is cantileverwise supported at its hub 2*b*. At this point, a sleeve can be manually replaced or simply inserted onto the cliché-carrying cylinder.

Once a sleeve has been inserted onto the cliché-carrying cylinder 2, the operator sends a command to the control electronic control unit, e.g. by pressing a suitable button (not shown in the drawings). Then, a fully automatic operation sequence starts, according to which slide support 5*a* is caused to move backwards until it slidingly engages with hub 2*a* to carry it into its respective coupling sleeve member 9 which is a standby open position, the inclined surface 10*b* being of assistance in this operation. After this, pneumatic motor 11 causes coupling sleeve 9 to be angularly displaced about its longitudinal axis to its closed position.

Unlike technical solutions so far proposed, according to the present invention both main or interlocking cylinder handling operation and hub locking/unlocking operations of one cylinder are carried out in a fully automatic way by the control unit of the printing machine control, with the assistance of a multiplicity of both telemetric and position sensor members, as is well-known to a skilled person in the art. No operator's intervention is required in carrying out handling operations of color assembly components, the operator being required only to remove/insert a sleeve when a cylinder is in a released position away from its support at the operator's side. Thus, the solution according to the present invention is suitable for ensuring a greater accuracy in positioning components of a color assembly and for preventing any damages that might be caused to them in the case of mishandling.

Figure 11:
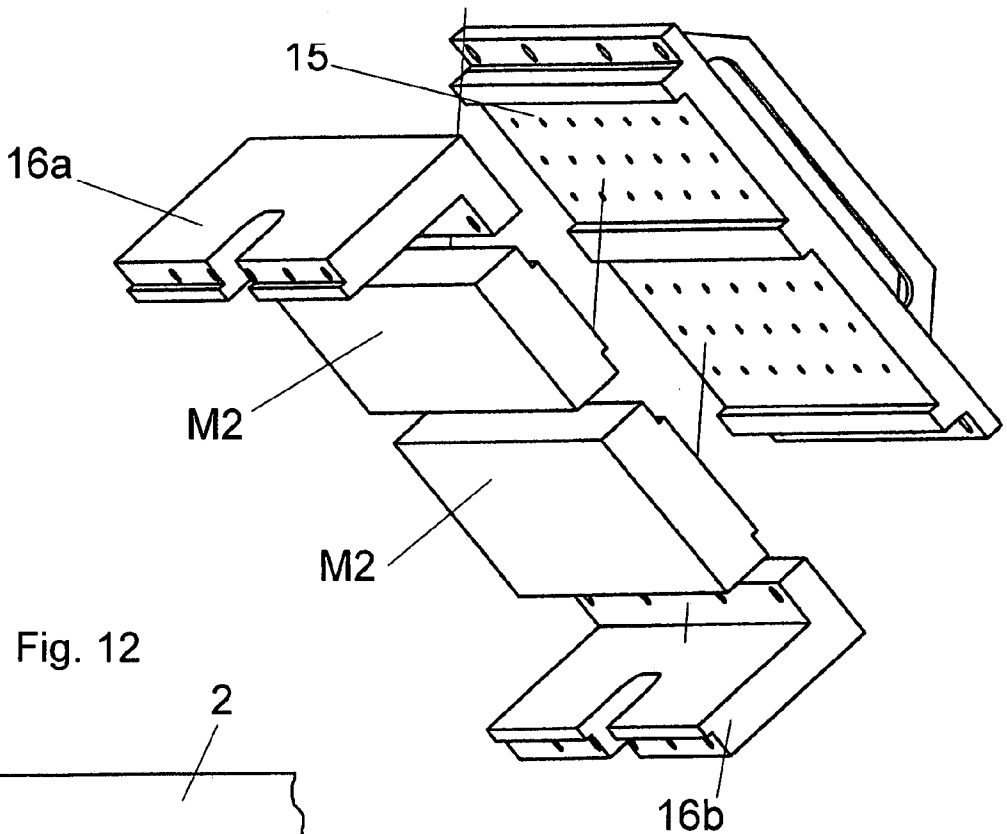
FIG. 11 is an exploded perspective view of a linear motor for driving the slidable supports of the supporting and releasably holding device according to the present invention.

FIG. 11 shows a portion of a linear motor M having a pair of windings M2 that are shaped so as to make it possible a partial shape engagement with a supporting plate 15, and fixed thereto in any suitable way. A shaped shoulder or support 16*a* and 16*b* is fixed to two a respective end of the supporting plate 15, near to a side of each winding M2, and to a printing machine side for linear motor M for the slidable supports 5*a*, 5*b*, and on a longitudinal portion of the same supports 5*a* and 5*b* for linear motor M for slidable supports 4*a* and 4*b*. In this way, an operative area or section is delimited, within which each slide support 4*a*, 4*b* and 5*a*, 5*b* can freely slide due to action of permanent magnets M1. One or more permanent magnets M1 are thus facing the respective coil or coils M2, which, when a current passes through them, generate a magnetic field interacting with field generated by permanent magnets thereby obtaining a displacement force for its slide support 4*a*, 4*b* and 5*a*, 5*b*, respectively, which thus is caused to be displaced.

Figure 1:
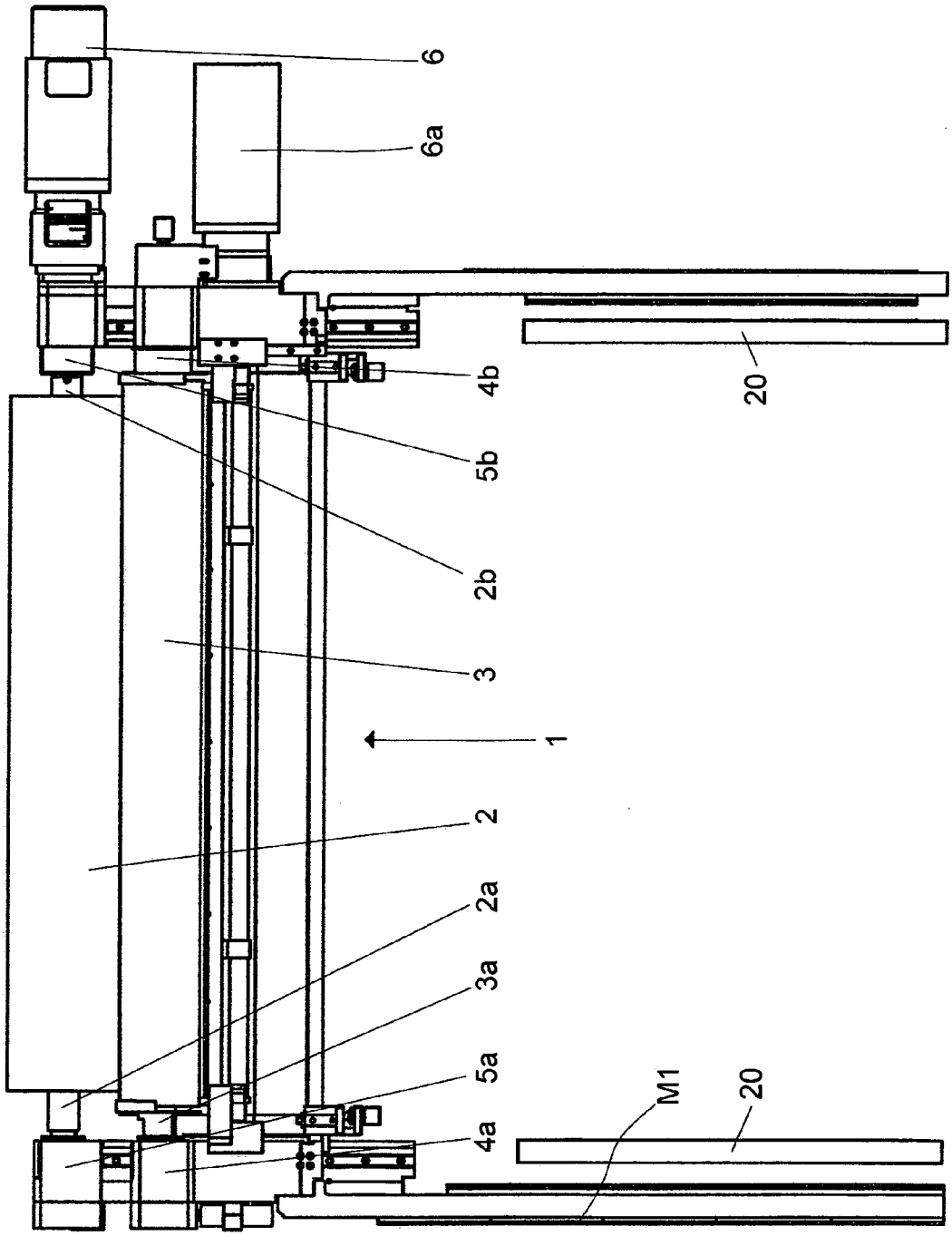
FIG. 1 shows a plan view of a color assembly of a flexographic machine according to the present invention.
Figure 3:
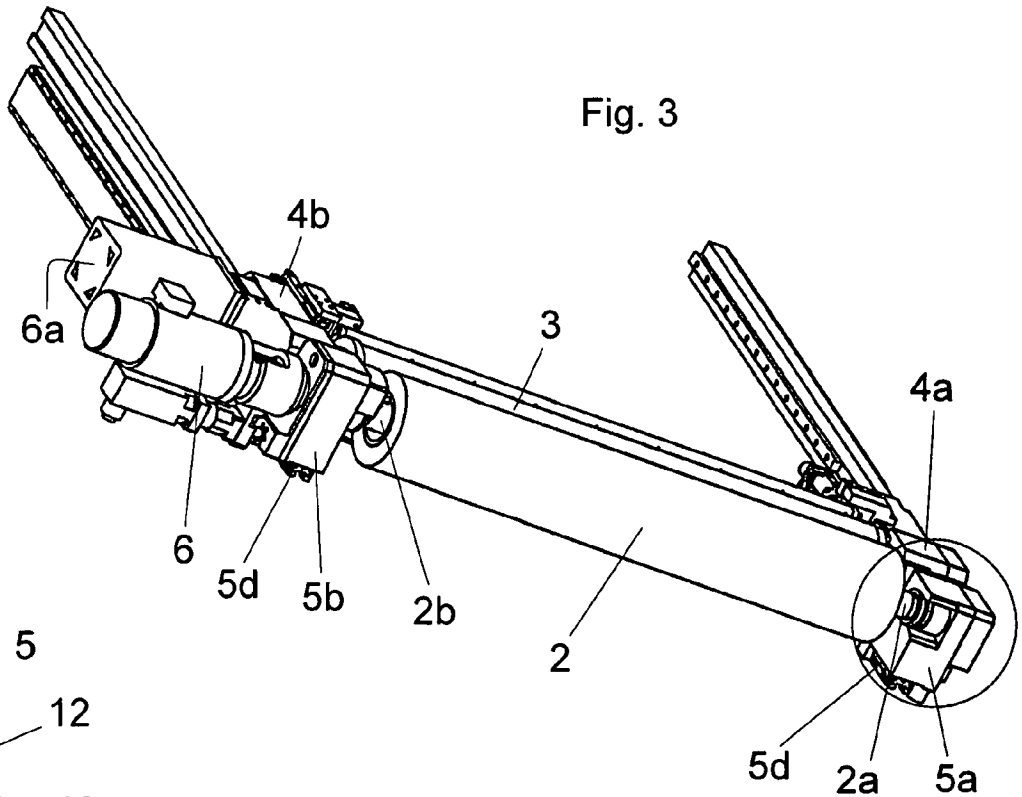
FIG. 3 is a perspective view slightly from above of the color assembly of FIG. 1.
Figure 4:
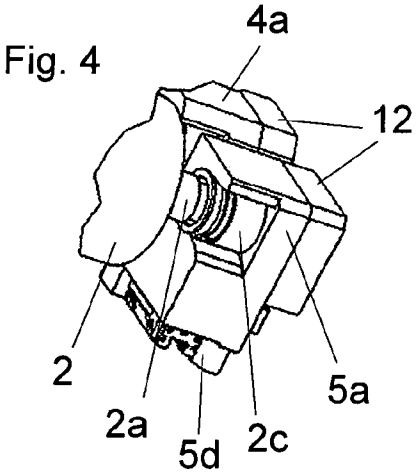
FIG. 4 illustrates a perspective view on an enlarged scale of a circled detail in FIG. 3.

To accurately detach the position of cylinders 2 and 3 and slidable supports 5*a*, 5*b* and 4*a*, 4*b* both with respect to one another and the counterpressure drum, there a linear encoder 20 (one for each linear motor) is provided on each printing machine side (FIG. 1). Each encoder 20 can be either of a suitable magnetic or optical type.

It will be noted that motor stator comprises coils M2, whereas the mobile (motive) motor portion comprises permanent magnets M1, whilst in linear motors currently in use mobile motor portion comprises a coil or coils and the stator portion is constituted by permanent magnets. With the above described configuration, however, the drawback of having to displace respective power supply cables together with coils M2, e which would require the use of a coiler/uncoiler, and the risk of explosion in a contaminated environment are avoided.

Another advantage in choosing a linear motor M in lieu of a conventional coupled rotary motor, e.g. together with ball screws, is that of avoiding clearances between ball screws and motor, and of taking advantage of the fact that, power and torque conditions being the same, a linear motor ensure a greater accuracy in operation.

In its sleeve replacing position, slide support 5*b* of hub 2*b* (motor side) cantileverwise supports the whole weight of cylinder 2. This might generate a bending moment and thus shearing stress, which in time may cause deformations in the hub 2*b* and/or the support.

Figure 12:
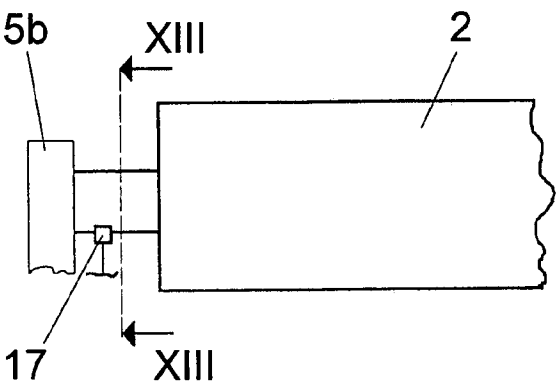
FIG. 12 is a diagrammatic partial plan view of a main or cliché-carrying cylinder cantileverwise supported by both a supporting device for replacing a sleeve according to the present invention and by an auxiliary cradle supporting means provided at the motor side of the printing machine.
Figure 13:
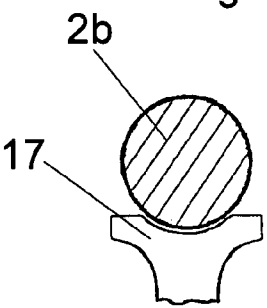
FIG. 13 is a diagrammatic cross-sectional view on enlarged scale taken along line XIII-XIII of FIG. 12.

To eliminate this drawback, there an auxiliary support means 17 is provided that is positioned at the hub side of the cliché-carrying cylinder, and acts as an supplementary support for hub 2*b* when the other cylinder hub 2*a* has been released from its slidable support 5*a* (operator side), thereby drastically reducing any bending moment acting on hub 2*b*, e.g. as diagrammatically illustrated in FIGS. 12 and 13.

The auxiliary support means 17 can have any suitable shape, e.g. they can be cradle-shaped, either fixed in position or removable, in which case suitable actuator means will be provided designed to cause it to move between a work position and a rest position in synchronization with the movements of the slide support 5*a* of hub 2*a*, as it will clearly understood by a skilled person in the art.

The invention as described above is susceptible to numerous modifications and variations within its scope as defined by the claims.

The invention claimed is:

1. A supporting and releasably holding device for a hub of a printing machine cylinder, which comprises a first pair of slidable supports parallelly displaceable along a first path independently from one another, a second pair of slidable supports parallelly displaceable along a second path parallel to said first path independently from one another, a main or cliché-carrying cylinder, and a screened or interlocking cylinder, each cylinder being supported for rotation at its hubs by respective supports of said first and second pair of supports, and drive means for each slidable support, wherein at least one slidable support of said first and said second pairs of supports for at least said main cylinder comprises a receiving seat with side inlet-outlet mouth designed to support for rotation a coupling member formed with a longitudinal slit for inserting/removing a respective hub of said main cylinder, and drive means for said coupling member to angularly displace it around its longitudinal axis in said receiving seat between a lateral open position, in which said longitudinal slit is positioned facing said inlet-outlet mouth for its respective hub of said main cylinder, and a closed position, in which said longitudinal slit is angularly displaced with respect to said inlet-outlet mouth.

2. A device as claimed in claim 1, wherein each slidable support comprises at least one inclined plane-shaped portion at said respective inlet-outlet mouth.

3. A device as claimed in claim 1, wherein each pair of slidable supports is displaceable between a work position, in which its respective coupling member is in its closed position and supports a respective hub, and a rest position far from its respective hub after change of position of its respective coupling member to its open position thereby setting its respective cylinder cantileverwise on the other end hub support thereof.

4. A device as claimed in claim 3, comprising an auxiliary support means for at least said main cylinder when in its cantileverwise position.

5. A device as claimed in claim 4, wherein said auxiliary support means is fixed.

6. A device as claimed in claim 4, wherein said auxiliary support means is displaceable between a work position abutting against a portion of said hub and a rest position far from said hub.

7. A device as claimed in claim 4, wherein said auxiliary support means is cradle-shaped.

8. A method of replacing a printing machine sleeve, using a supporting and releasably holding device as claimed in claim 4, which method comprises the steps of:

providing said main cylinder at a rest position relatively far from a counterpressure drum and from said interlocking cylinder;

angularly displacing about its longitudinal axis at a sleeve replacing side of said printing machine said coupling member to said open position, thereby allowing its respective hub to pass through it;

displacing said support for said coupling member transversally with respect to said longitudinal axis of said coupling member from a working position to a sleeve replacement position, thereby releasing and moving away from its respective hub of said main cylinder, which is thus cantileverwise positioned;

supporting said cylinder through an auxiliary support means arranged against said hub opposite to said displaced support;

inserting or replacing a sleeve on said main cylinder;

displacing said support from replacing position of said printing sleeve to a support position of said hub; and angularly displacing said coupling member to said closed position thereby holding the respective hub of said main cylinder in position.

9. A device as claimed in claim 1, comprising at least one splash guard member for said interlocking cylinder.

10. A device as claimed in claim 9, wherein said splash guard member is fixed to a respective coupling member.

11. A device as claimed in claim 1, wherein said drive means comprises at least one linear motor.

12. A device as claimed in claim 11, wherein said at least one linear motor comprises at least one linear encoder.

13. A method of replacing a printing machine sleeve, using a supporting and releasably holding device as claimed in claim 1, which method comprises the steps of:

providing said main cylinder at a rest position relatively far from a counterpressure drum and from said interlocking cylinder;

angularly displacing about its longitudinal axis at a sleeve replacing side of said printing machine said coupling member to said open position, thereby allowing its respective hub member to pass through it;

displacing said support for said coupling member transversally with respect to said longitudinal axis of said coupling member from a work position to a sleeve replacement position, thereby releasing, and moving away from, its respective hub member of said main cylinder, which thus takes a cantilever position;

inserting onto, or replacing a sleeve on said main cylinder;

moving backwards said support for said coupling member from said sleeve replacement position to said work position; and angularly displacing said coupling member to said closed position thereby holding in position its respective hub member of said main cylinder.

14. A method of sleeve replacing as claimed in claim 13, comprising a final step of moving said main cylinder from said rest position to a working position against said counterpressure drum.

* * * * *